United States Patent [19]

Bingham

[11] Patent Number: 5,062,627

[45] Date of Patent: Nov. 5, 1991

[54] RECIPROCATOR FOR A STEPPER EXERCISE MACHINE

[75] Inventor: Curt G. Bingham, Logan, Utah

[73] Assignee: Proform Fitness Products, Inc., Logan, Utah

[21] Appl. No.: 644,456

[22] Filed: Jan. 23, 1991

[51] Int. Cl.[5] ..... A63B 23/04

[52] U.S. Cl. ..... 272/70

[58] Field of Search ..... 272/70, 69, 71, 96, 272/97, 130, 135, 73

[56] References Cited

U.S. PATENT DOCUMENTS 4,600,187 7/1986 Scherker ..... 272/70

4,830,362 5/1989 Bull ..... 272/70

4,838,543 6/1989 Armstrong et al. ..... 272/70

*Primary Examiner*—Stephen R. Crow

*Attorney, Agent, or Firm*—Trask, Britt & Rossa

[57] ABSTRACT

A reciprocator for use with a stepper-type exercise machine has a channel as a rocker element. The channel has left and right ends which rotate about a pivot axis below the pedals. Rollers are mounted at each end of the channel. The rollers have a groove to engage with arcuate roller engagement structures attached to the underside of each pedal. The rollers are each mounted on a mount bar which spans the opening of the channel at the left and right ends. A pair of springs are positioned at each end to urge the roller away from the sides of the channel.

12 Claims, 3 Drawing Sheets

Fig. 2

RECIPROCATOR FOR A STEPPER EXERCISE MACHINE

BACKGROUND

1. Field

This invention relates to exercise machines, and more particularly to stepper exercise machines.

2. State of the Art

Steppers and climbers all have a pair of foot pedals or treadles with a resistance connected to resist stepping movements. Typical machines are synchronized so that as one pedal or treadle is pushed downward by the user's foot, the other one rises upward. An essential aspect of a stepper, then, is a means to synchronize the reciprocating action of the foot bars.

U.S. Pat. No. 4,600,187 (Schenker) discloses a step exerciser with a rocker plate having holes at the opposing ends through which pass the left and right step arms. Schenker does not compensate for either the arcuate travel of the ends of the rocker plate in their plane of vertical travel, or the analogous arcuate travel of the step arms in their plane of travel. The result is that the step arms will shift back and forth in the holes of the rocker arm, which may cause rough and noisy action and substantial wear on the parts.

A rocker is also employed in the apparatus disclosed in U.S. Pat. No. 4,830,362 (Bull). In this case, the foot levers are connected via tie rods to the rocker ends. In the Bull apparatus, the arcuate travel of the levers is compensated for by pivots at the points connecting the tie rods to the rocker ends and the foot bars. The linkage arrangement is complex, relatively easily damaged by improper assembly, and subject to frictional wear at all of the pivot points.

A third rocker-type reciprocator is found in an exercise machine marketed by Voit and shown in FIGS. 5 and 6. In this assembly, the arcuate travel of the levers is accommodated by having the ends of a rocker bar slide on rollers attached to the underside of each lever. However, the arrangement requires capturing the rocker bar on the rollers. This arrangement is complicated, requiring accurate alignment and narrow construction tolerances, and is therefore difficult to manufacture.

A simplified rocker reciprocator for a stepper machine which has smooth, quiet action with a minimum of parts subject to friction is needed. Also, a reciprocator which can be easily assembled from a compact disassembled state by a home user is needed.

SUMMARY OF THE INVENTION

An exercise machine has a frame for positioning on a support surface. A left lever means is pivotally secured to the frame means for movement relative thereto by a user. Right lever means is also pivotally secured to the frame means spaced from and in general alignment with the left lever means for movement relative to the frame means by a user. Resistance means is interconnected between the left and right lever means and the frame means to resist movement of the left and right lever means. Rocker means is attached to the frame means to rotate about a rotation axis. The rocker means has a left end and a right end which rotate about the rotation axis. Left and right tracking means are attached to the left end and right end of the rocker means respectively for movement therewith. Left engagement means and right engagement means are each attached to the underside of the left lever means and right lever means respectively to engage the left tracking means and right tracking means, respectively. The left engagement means and right engagement means respectively urge the left tracking means and right tracking means to track along the respective right and left engagement means upon movement of the left and right lever means, respectively.

In a preferred arrangement, the left tracking means has a left tracking shaft mounted at the left end and a left tracking member adapted to the shaft to move therealong. Similarly, it is preferred that the right tracking means have a right tracking shaft mounted at the right end with a right tracking member adapted to the shaft to move therealong. Desirably, the left tracking member is a left roller and the right tracking member is a right roller. The left and right rollers respectively rotate about the left and right tracking shafts respectively. In a preferred embodiment, the left engagement means is a left ridge and the left roller has a perimeter shaped to coact with the left ridge. Also, the right engagement means is a right ridge; and the right roller has a perimeter shaped to coact with the right ridge.

In another configuration, the rocker means is a channel having spaced-apart sides. The left tracking shaft is transversely secured to the channel at its left end to extend between the spaced-apart sides. The right tracking shaft is also transversely secured to the channel at its right end to extend between the spaced-apart sides of the channel. More preferably, the left ridge and right ridge are both arcuate in cross-section. The perimeters of both the left roller and the right roller are concave in shape.

In a highly preferred arrangement, spring means is positioned to urge the left and right roller inwardly along the said left tracking shaft and right tracking shaft, respectively, from their respective ends.

In a preferred arrangement, the frame means includes an upright support. The left lever means is a treadle secured to the upright support to pivot about a first pivot axis. The left lever means is also a treadle pivotally secured to an upright support to pivot about a first pivot axis. The resistance means is preferably a left hydraulic cylinder interconnected between the left treadle and the upright support. The right resistance means also includes a right hydraulic cylinder interconnected between the right treadle and the upright support.

Preferably, the exercise machine is a stepping machine operable by the feet of a user in performing stepping-type exercises.

BRIEF DESCRIPTION OF THE DRAWINGS

In the drawings, which illustrate what is presently regarded as a preferred embodiment.

DETAILED DESCRIPTION OF THE INVENTION

Figure 1:
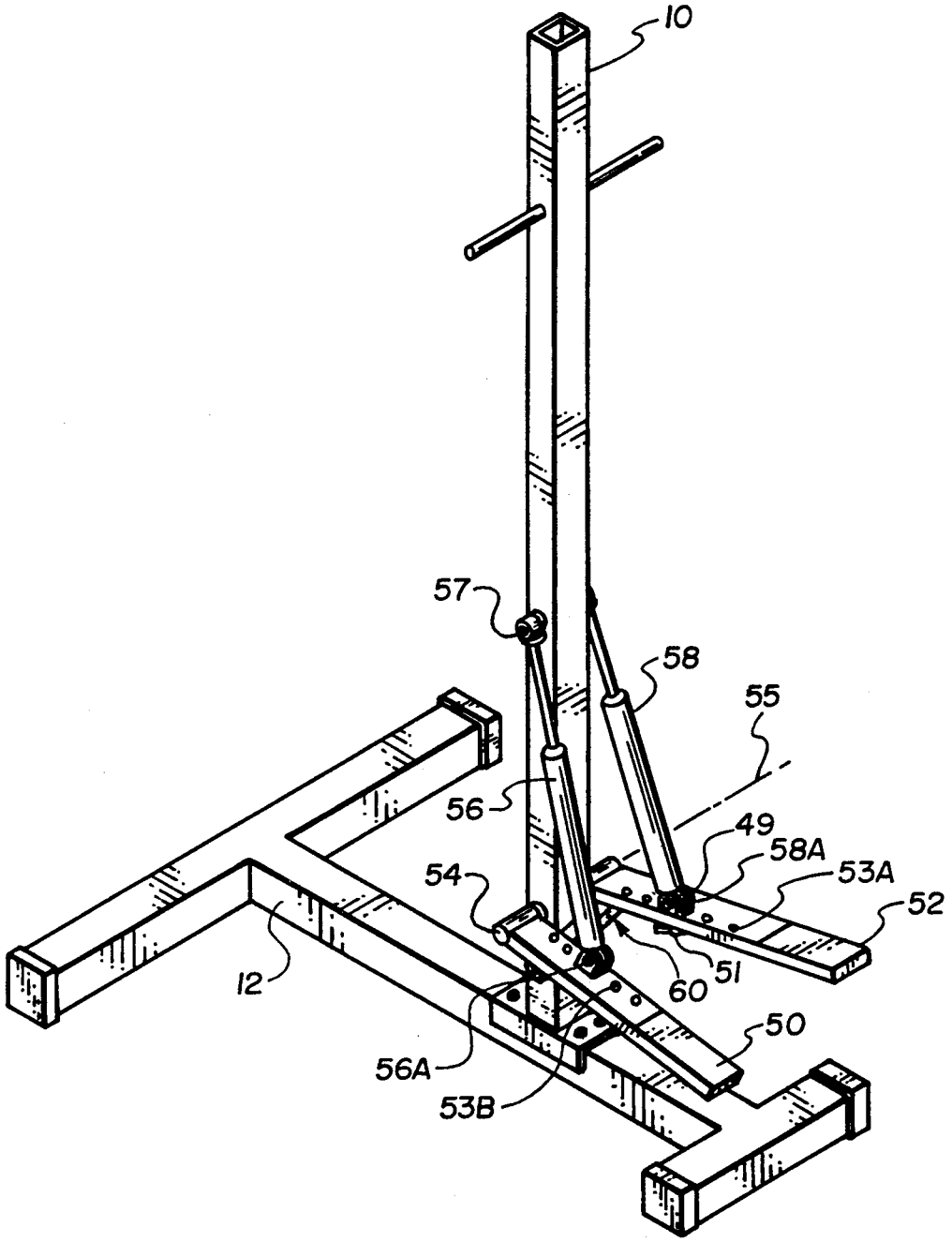
FIG. 1 is a partial perspective view of a machine having a reciprocator of the invention.

A stepper apparatus of the type shown generally in includes an upright frame member 10 mounted on a base which is positioned to stably support the apparatus on a support surface. A pair of treadles or pedals 50 and 52 are mounted by pedal mounting means to the frame member 10. The pedal mounting means here shown is an axle 54 which extends through the left pedal 50, through the frame member 10 and through the right pedal 52. The pedals 50 and 52 therefore pivot about axis 55.

A reciprocator assembly 60 is mounted to the frame member 10 below the pedal mounting means 54. The reciprocator assembly 60 causes the pedals 50 and 52 to reciprocate with respect to each other. Hydraulic cylinders 56 and 58, constituting pedal resistance means to resist movement of the pedals 50 and 52, are operably connected at their lower ends to the pedals 50 and 52, and at their upper ends by a bolt 57 to the frame member 10. The effective resistance to a user performing a stepping exercise may be varied by securing brackets 56A and 58A at the lower ends of the cylinders 56 and 58 with bolts 49 to a desired hole 53A and 53B formed through pedals 50 and 52 as shown. That is, the brackets 56A and 58A are pivotally mounted to the ends of the cylinders 56 and 58, respectively. A bolt 49 extends through the bracket 56A and 58A and its respective pedal 50 and 52 for connection to a wing nut 51 to secure the cylinders 56 and 58 to their respective pedals 50 and 52 in the desired hole 53 to obtain a selected resistance level.

Figure 2:
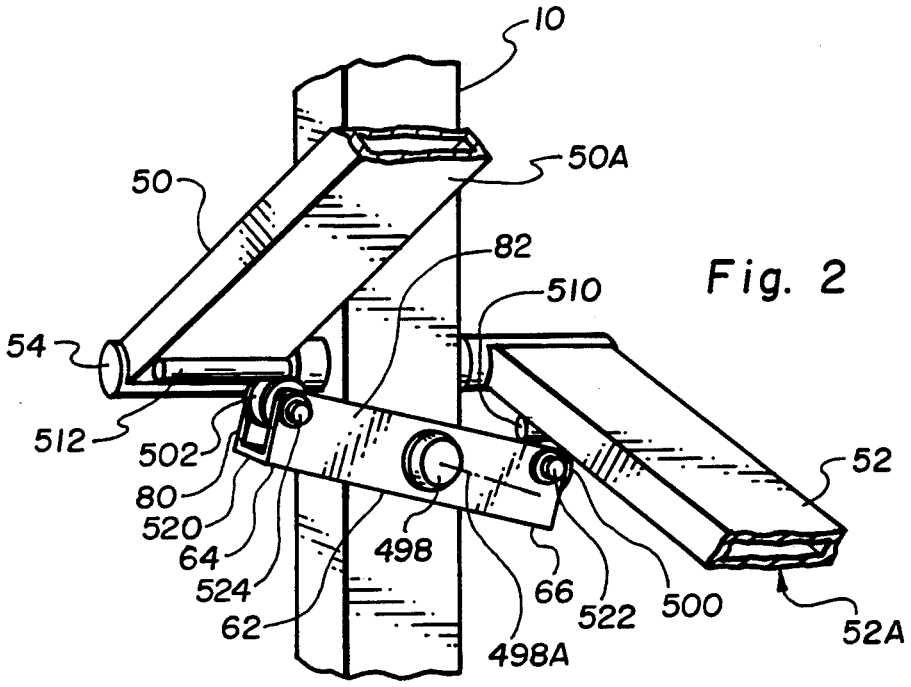
FIG. 2 is a partial perspective view of the reciprocator of the invention.
Figure 3:
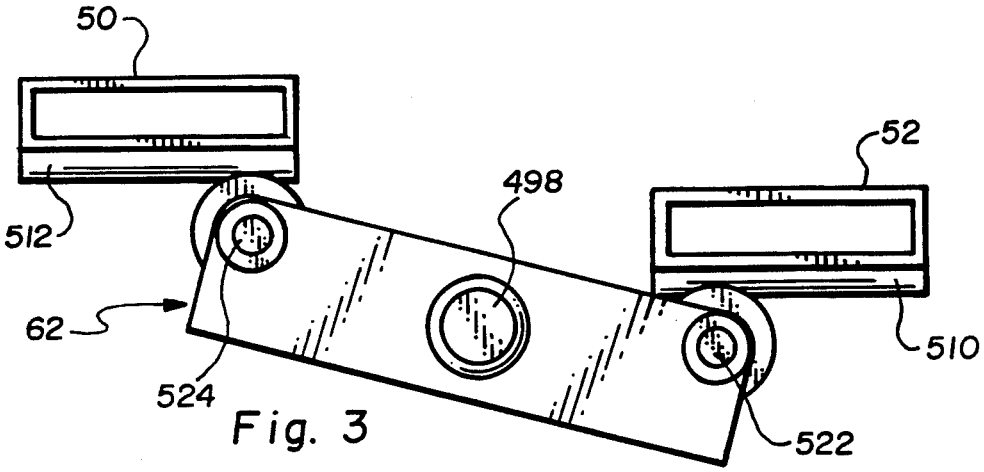
FIG. 3 is a front elevational view of the reciprocator of FIG. 2.
Figure 4:
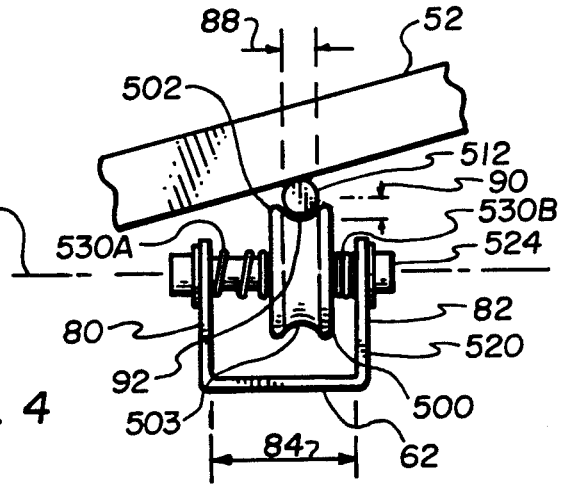
FIG. 4 is a partial side elevational view of the reciprocator of FIG. 2.
Figure 5:
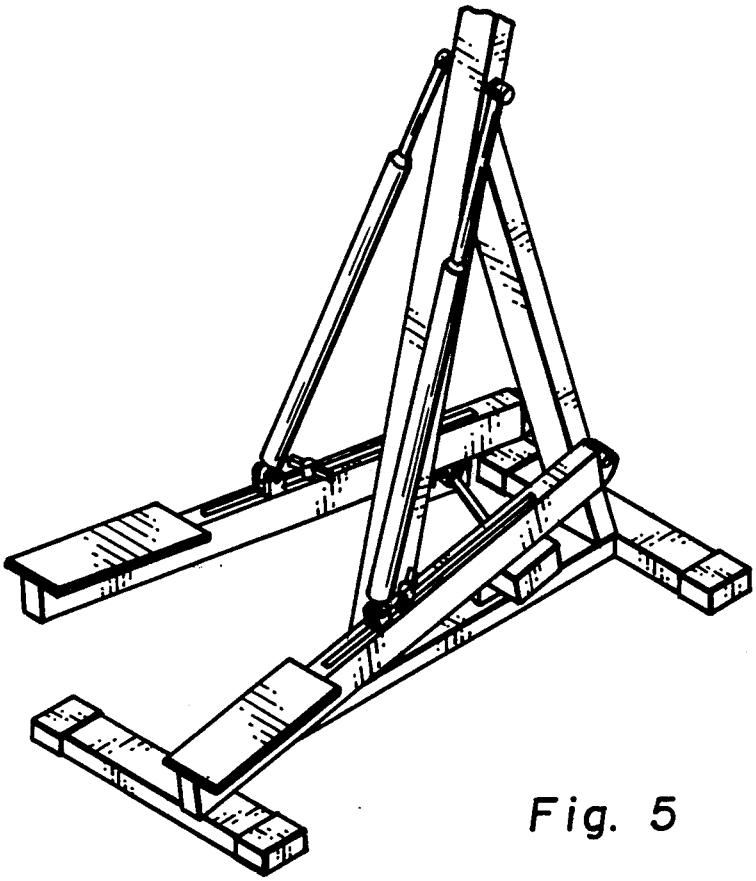
FIG. 5 is a perspective view of a stepper machine having a prior art reciprocator.
Figure 6:
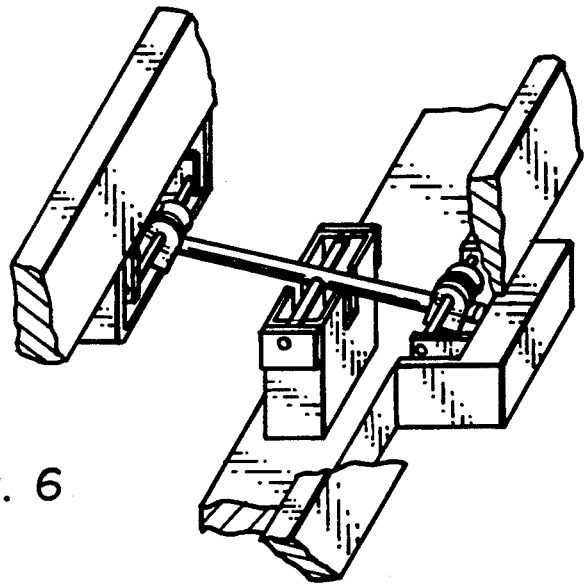
FIG. 6 is a detail view of the prior art reciprocator of FIG. 5.

The reciprocator assembly 60 is seen in detail in FIGS. 2–4. Rocker element 62 is pivotingly mounted at its center to the frame member 10 to rotate about a rocker axle 498 and in turn a rocker axis 498A. The opposing ends 64 and 66 of the rocker element 62 are sized to extend away from the axle 498 to engage the undersides 50A and 52A of the pedals 50 and 52. Left and right rocking means are mounted at the ends 64 and 66 of the rocker element 62 to interface with left and right engagement means positioned on the underside 50A and 52A of each pedal 50 and 52. That is, the tracking means and the engagement means interact to cause the tracking means to track or move along the engagement means. As here shown, the left tracking means is a roller 502 and the right tracking means is a roller 500. The rollers 500 and 502 are mounted on the ends 64 and 66 of the rocker 62. Although rollers 500 and 502 are preferred for the arrangement illustrated, other structure may be used to effect the tracking relationship between the engagement means and the tracking means.

In a preferred embodiment, each roller 500 and 502 has a circumferential groove such as groove 503 (FIG. 4) formed in roller 502 to interfit or mate with the engagement means which is the left and right roller engaging structures 510, 512 attached to the underside 52A and 50A of each of the pedals 52 and 50, respectively. As a pedal 50 or 52 is depressed, its attached roller engaging structure 512 and 510 engages with and bears down on its respective roller 502 and 500, and in turn on the corresponding end 64 or 66 of the rocker element 62. The corresponding end 64 or 66 of the rocker element 62 is thus pushed downward, causing the rocker 62 to pivot about the axle 498 thereby displacing the opposing end 64 or 66 of the rocker 62 upward and raising the opposite pedal 50 or 52 (FIGS. 2 and 3). The reciprocator 60 thus causes the pedals to reciprocate in use.

As here shown, the rocker element 62 is an upward-facing open channel 520 with spaced-apart opposite sides 80 and 82. The sides 80 and 82 are spaced apart a distance 84 selected to receive the rollers 510 and 502 therein and to permit their movement along a tracking shaft. That is, the rollers 500 and 502 are each slidably mounted on a tracking shaft 522 and 524 which both extend between the spaced-apart sides 80 and 82 of the channel 520 and are essentially perpendicular thereto, as best seen in FIG. 4. The rollers 500 and 502 have apertures sized to slidably receive their respective tracking shafts 522 and 524 so that the rollers 500 and 502 may move on its respective tracking shaft 522 and 524 along the axis 86 thereof between the spaced-apart sides 80 and 82.

As best seen in FIG. 4, the roller engaging means 510 and 512 are ridges which are shown as cylinders or bars attached to the underside 52A and 50A of pedals 52 and 50 to 5 engage the groove 503 of rollers 500 and 502. The groove 503 is sized in width 88 and depth 90 to receive the bar so that upon movement of the appropriate pedal 50 and 52, the bar 512 acts against the surface 92 of the groove 503 to urge the rollers 500 and 502 back and forth along their respective tracking shafts 522 and 524. That is, in FIG. 4, as the pedal 52 moves up and down, the roller 500 slides back and forth between the sides 80 and 82 of the channel 520 on the tracking shaft 524. The sliding action of the rollers 500 and 502 thus permits the channel 520 to remain fixed even though the pedals 50 and 52 and in turn the engagement bars 510 and 512 move in an arc about axis 55.

Spring means is mounted to urge the rollers 500 and 502 away from the sides 80 and 82 toward a central region of the tracking shafts 522 and 524 to facilitate their engagement with the roller engaging bars 510 and 512. That is, to avoid a dead spot where roller 500 or 502 would not be prone to move on its respective tracking shaft 522 and 524, the spring means is positioned to urge the roller 500 and 502 in a direction toward the central region or midpoint of its respective tracking shaft 522 and 524 between the opposite sides 80 and 82 of the channel 520.

In FIG. 4, the spring means is shown as a front spring 530A and a rear spring 530B. Each is a helical spring with the tracking shaft 524 positioned therethrough. The springs thus act against the sides 80 and 82 of the channel 520 and against the roller 500. The arrangement at the other end 64 of the channel 520 is substantially the same and not here shown.

The rollers 500, 502 may be made of any suitable material, but are desirably formed of relatively rigid nylon or similar material including polypropylene. The springs 530A and 530B may be fashioned of any appropriate material including both plastics and metals, which have the desired resilient characteristics. Bushings or bearings may be used where appropriate to support the axle 498 as it passes through the rocker 62 and the frame member 10. The roller engaging structure 510 and 512 may be welded to the underside of the pedals. The tracking shafts 522 and 524 will desirably be removably mounted through apertures as formed in the sides 80 and 82 of the channel 520 to facilitate placement of the rollers 500 and 520 and springs 530A and 530B. Bushings and/or washers may be used as desired to facilitate installation of tracking shafts 522 and 524.

The reciprocator 60 disclosed is simple and durable. It can be easily assembled from a compact, partially disassembled state to an operational state on the stepper machine. Therefore, a stepper machine with this reciprocator 60 may be shipped partially disassembled, so that the cost of shipping may be reduced. Also, the manufacturing tolerances within which smooth and reliable reciprocating action is achieved are relatively broad, making for inexpensive and reliable manufacture.

It will be recognized by those in the art that various equivalents may be used in place of individual specific structures as shown and described herein, without deviating from the concept of the invention. Further, the disclosed embodiments are not intended to limit the scope of the claims which themselves recite those features essential to the invention.

What is claimed:

1. An exercise machine comprising:

frame means for positioning on a support surface;

left lever means pivotally secured to said frame means for movement relative thereto by a user;

right lever means pivotally secured to said frame means spaced from and in general alignment with said left lever means for movement relative to said frame means by a user;

resistance means interconnected between said left lever means and said frame means and between said right lever means and said frame means to resist movement thereof;

rocker means attached to said frame means having a left end extending under said left lever means and a right end extending under said right lever means, said rocker means having a rotation axis about which said left end and said right end rotate;

left tracking roller means attached to the left end of said rocker means for movement therewith;

right tracking roller means attached to the right end of said rocker means for movement therewith;

left engagement means attached to the underside of said left lever means to engage said left tracking roller means for urging said left tracking roller means to track along said left engagement means upon movement of said left lever means; and right engagement means attached to the underside of said right lever means to engage said right tracking roller means for urging said right tracking roller means to track along said right engagement means upon movement of said right lever means.

2. The exercise apparatus of claim 1 wherein said left tracking roller means has a left tracking shaft mounted at said left end and a left tracking member adapted to said shaft to move therealong.

3. The exercise machine of claim 2 wherein said right tracking roller means has a right tracking shaft mounted at said right end and a right tracking member adapted to said shaft to move therealong.

4. The exercise machine of claim 3 wherein said left tracking member is a left roller and wherein said right tracking member is a right roller.

5. The exercise machine of claim 4 wherein said left engagement means is a left ridge and said left roller has a perimeter shaped to coact with said left ridge, and wherein said right engagement means is a right ridge and said right roller has a perimeter shaped to coact with said right ridge.

6. The exercise machine of claim 5 wherein said rocker means is a channel having spaced-apart sides, wherein said left tracking shaft is transversely secured to said channel at its left end to extend between said spaced-apart sides, and wherein said right tracking shaft is transversely secured to said channel at its right end to extend between the spaced-apart sides of said channel.

7. The exercise machine of claim 6 further including spring means positioned to urge said left roller and said right roller inwardly along their said left tracking shaft and said right tracking shaft respectively from their respective ends.

8. The exercise machine of claim 7 wherein said left ridge and right ridge are both arcuate in cross-section and wherein the perimeters of both said left roller and said right roller are concave in shape.

9. The exercise machine of claim 8 wherein said frame means includes an upright support, wherein said left lever means is a treadle pivotally secured to said upright support and wherein said right lever means is a treadle pivotally secured to said upright support.

10. The exercise machine of claim 9 wherein said resistance means is a left hydraulic cylinder interconnected between said left treadle and said upright support and a right hydraulic cylinder interconnected between said right treadle and said upright support.

11. A stepping machine comprising:

a base for positioning on a support surface;

an upright support connected to said base and extending upwardly therefrom;

a left treadle pivotally mounted to said upright support to pivot about a first pivot axis, said left treadle being positioned for movement by a foot of the user;

a right treadle pivotally mounted to said upright support to pivot about said pivot axis, said right treadle being generally aligned with and spaced from the left treadle for movement by the other foot of the user;

a left hydraulic cylinder interconnected between said upright support and said left treadle to resist movement of said left treadle;

a right hydraulic cylinder interconnected between said upright support and said right treadle to resist movement of said right treadle;

a channel having two spaced-apart sides, a left end and a right end mounted to said upright support to pivot about a second pivot axis below said first pivot axis;

a left tracking shaft transversely secured to said channel proximate said left end;

a right tracking shaft transversely secured to said channel proximate said right end;

a left roller mounted to said left tracking shaft to move therealong;

a right roller mounted to said right tracking shaft to move therealong;

left engagement means secured under said left treadle to mechanically engage the perimeter of said left roller to urge said roller to move on said left tracking shaft upon movement of said left treadle; and right engagement means secured under said right treadle to mechanically engage the perimeter of said right roller to urge said right roller to move on said right tracking shaft upon movement of said right treadle.

12. In an exercise machine having a frame, left and right limb pedals movably mounted thereto and operated by alternating motions of left and right limbs of a user on said limb pedals, and resistance devices connected between said frame and each of said limb pedals, a reciprocator comprising:

rocker means for providing reciprocating motion and having left and right rocker ends positioned under said left and right limb pedals, said rocker means being rotatably mountable to said frame below the point of attachment of said limb pedals at a pivot, said rocker means being operable to perform a first movement in which said left rocker end moves generally downward and said right rocker end moves generally upward, and a second position in which said right rocker end moves generally downward and said left rocker end moves generally upward;

left and right roller structures, mounted on said left and right rocker ends respectively; and roller engagement means attached to the underside of each of said left and right limb pedals for engaging said left and right roller structures, respectively, said roller engagement means being positioned on each of said left and right limb pedals to contact said roller structures upon movement of said left limb pedal and said right limb pedal to cause said rocker means to move alternatingly between said first position and said second position.

* * * * *